US010407130B2

(12) United States Patent
Merchant et al.

(10) Patent No.: US 10,407,130 B2
(45) Date of Patent: Sep. 10, 2019

(54) DRILLING TENDER UNIT

(71) Applicant: Keppel Offshore & Marine Technology Centre Pte Ltd, Singapore (SG)

(72) Inventors: Aziz Amirali Merchant, Singapore (SG); Suryanarayana Murthy Pasumarthy, Singapore (SG); Chongyong Huang, Singapore (SG)

(73) Assignee: KEPPEL OFFSHORE & MARINE TECHNOLOGY CENTRE PTE LTD, Singapore (SG)

( * ) Notice: Subject to any disclaimer, the term of this patent is extended or adjusted under 35 U.S.C. 154(b) by 0 days.

(21) Appl. No.: 15/780,203

(22) PCT Filed: Dec. 5, 2016

(86) PCT No.: PCT/SG2016/050590

§ 371 (c)(1),
(2) Date: May 30, 2018

(87) PCT Pub. No.: WO2017/095334

PCT Pub. Date: Jun. 8, 2017

(65) Prior Publication Data

US 2019/0002058 A1 Jan. 3, 2019

(30) Foreign Application Priority Data

Dec. 4, 2015 (SG) ..... 10201509987T

(51) Int. Cl.
*B63B 39/00* (2006.01)
*B63B 1/12* (2006.01)
*B63B 35/28* (2006.01)
*B63B 35/44* (2006.01)

(52) U.S. Cl.
CPC ..... *B63B 1/121* (2013.01); *B63B 1/125* (2013.01); *B63B 35/28* (2013.01); *B63B 35/4413* (2013.01); *B63B 39/00* (2013.01)

(58) Field of Classification Search
CPC ..... B63B 1/121; B63B 1/125; B63B 35/28; B63B 35/4413; B63B 39/00
See application file for complete search history.

(56) References Cited

U.S. PATENT DOCUMENTS 3,461,828 A 8/1969 Bielstein
4,348,972 A 9/1982 Parsons
H000488 H * 7/1988 Rowan ..... 405/203
(Continued)

FOREIGN PATENT DOCUMENTS

CN 202358278 8/2012
SU 984917 12/1982

OTHER PUBLICATIONS

International Search Report from Australian Patent Office dated Feb. 28, 2017 for relating International Application No. PCT/SG2016/050590.

(Continued)

*Primary Examiner* — Stephen P Avila
(74) *Attorney, Agent, or Firm* — William P. Wilbar, IV

(57) ABSTRACT

This invention relates to a drilling tender unit. In particular, the invention relates to a drilling tender unit having a hull of trimaran or catamaran configuration.

4 Claims, 11 Drawing Sheets

(56) References Cited

U.S. PATENT DOCUMENTS

| | | | |
|---|---|---|---|
| 6,708,642 | B1 | 3/2004 | Taylor |
| 2005/0115484 | A1 | 6/2005 | Leitch et al. |

OTHER PUBLICATIONS

Written Opinion from Australian Patent Office dated Feb. 28, 2017 for relating International Application No. PCT/SG2016/050590.
International Preliminary Report on Patentability from Australian Patent Office dated Sep. 20, 2017 for relating International Application No. PCT/SG2016/050590.

* cited by examiner

300

DRILLING TENDER UNIT

CROSS REFERENCED APPLICATIONS

This application is a PCT National Phase Filing of PCT Application No. PCT/SG2016/050590 filed Dec. 5, 2016 that, in turn claims priority to Singapore Patent Application 1020150998T filed Dec. 4, 2015. Both of these application are hereby incorporated by reference in their entirety as if set forth herewith.

FIELD OF THE INVENTION

This invention relates to a drilling tender unit. In particular, the invention relates to a drilling tender unit comprising a hull of trimaran or catamaran configuration.

BACKGROUND

A conventional drilling tender barge or semi-submersible has a mono-hull with flat bottom. The operability of a drilling tender unit with respect to crane lifting is governed by the vertical motion at crane tip. For a barge, it becomes more challenging to operate in beam seas and quartering seas where the heave motion is coupled with roll motion. The downtime due to waiting on weather in severe weather conditions can be considerably high if the barge experience large roll motions.

Other types of hull designs, such as multi-hull designs have been used in the marine industry. However, these multi-hull designs are mostly used in high-speed ferry craft for its high speed to power ratio advantage, and for boats intended for shallow waters navigation.

It is therefore desirable to provide a drilling tender unit with improved designs that seeks to address at least some of the problems encountered in conventional drilling tender unit, or at least to provide an alternative.

SUMMARY OF INVENTION

In accordance with one aspect of the invention, an offshore drilling tender unit is provided. The offshore drilling tender unit comprises at least two elongated pontoon hulls disposed parallel to and spaced apart side-by-side in relation to one another; a deck box having an upper surface and a lower surface, wherein the deck box is arranged and supported onto the at least two elongated pontoon hulls such that one of the elongated pontoon hulls is disposed at a first longitudinal edge of the deck box and another one of the elongated pontoon hulls is disposed at a second longitudinal edge of the deck box, opposite the first longitudinal edge of the deck box. The drilling tender unit further comprises means for ballasting the drilling tender unit when required, to adjust a draft between a relatively low draft condition and a relatively high draft condition, wherein the means for ballasting are provided in each of the elongated pontoon hulls.

In accordance with some embodiments of this invention, the drilling tender unit comprises three elongated pontoon hulls, with the third elongated pontoon hull disposed between the two elongated pontoon hulls and at the center of the lower surface of the deck box, and equal distant from the two elongated pontoon hulls.

In accordance with many embodiments of this invention, each of the elongated pontoon hulls has, over its entire length, a substantially trapezoidal cross-section, with a longest edge in contact with the lower surface of the deck box.

In accordance with some embodiments of this invention, the third elongated pontoon hull has, over the entire length, a substantially triangular cross-section, with its base in contact with the lower surface of the deck box.

In accordance with a number of embodiments of this invention, wherein the means for ballasting further include means for adjusting trim and list of the drilling tender unit In accordance with some embodiments of this invention, the drilling tender unit is a drilling tender barge. In accordance with some other embodiments of this invention, the drilling tender unit is a semi-submersible drilling tender.

BRIEF DESCRIPTION OF THE DRAWINGS

The above advantages and features of a system in accordance with various embodiments of this invention are described in the following detailed description and are shown in the drawings.

DETAILED DESCRIPTION

In the following description, numerous specific details are set forth in order to provide a thorough understanding of various illustrative embodiments of the invention. It will be understood, however, to one skilled in the art, that various embodiments of the invention may be practiced without some or all of these specific details.

Some embodiments of the invention relates to an offshore drilling tender unit. In particular, the offshore drilling tender unit comprises multi-hulls in the form of a trimaran or catamaran design. The new improved concept in accordance with many embodiments of the present invention results in the drilling tender unit having reduced vessel motion and improved operability while maintaining similar arrangement and function as a conventional drilling tender unit.

Figure 1:
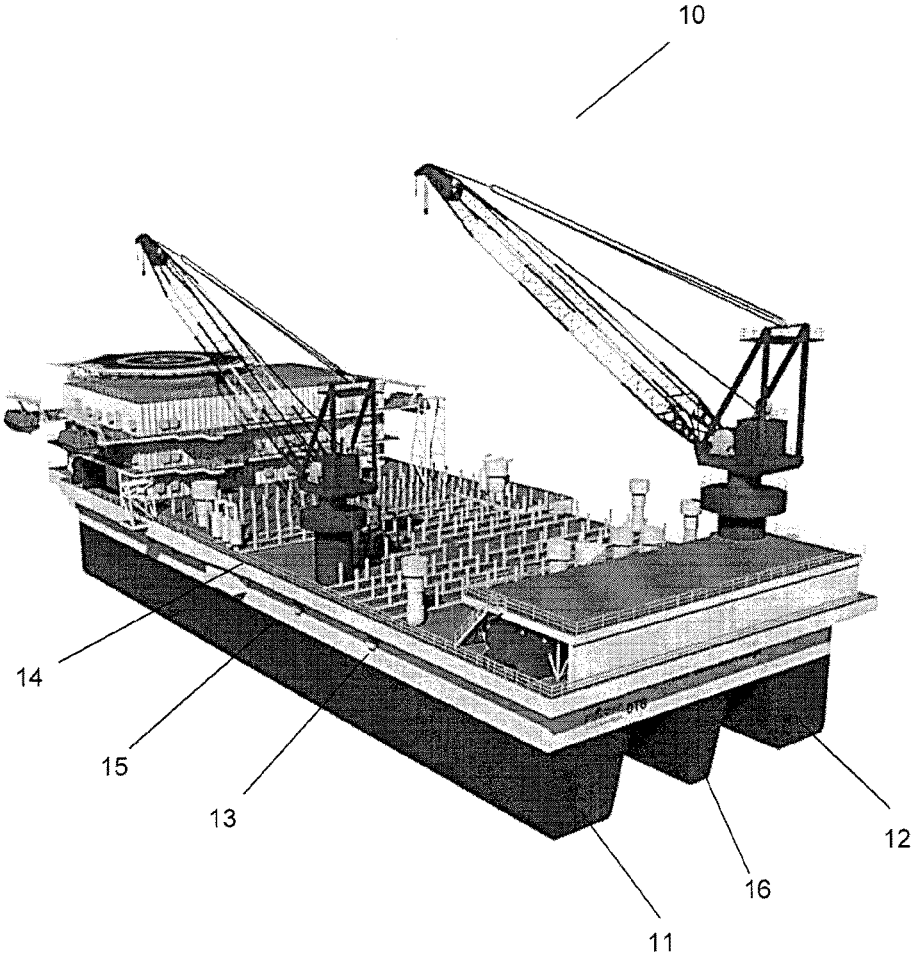
FIG. 1 illustrates a drilling tender unit comprising a hull of a trimaran configuration in accordance with an embodiment of the invention.
Figure 2:
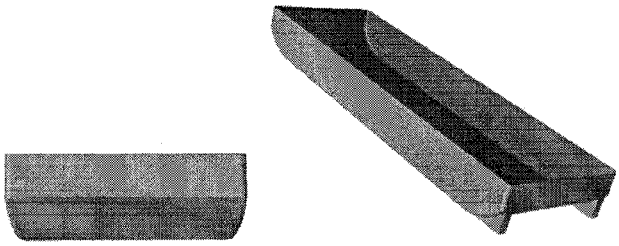
Figure 2 (Prior Art)
FIG. 2 illustrates a typical mono-hull in accordance with the prior art.
Figure 3:
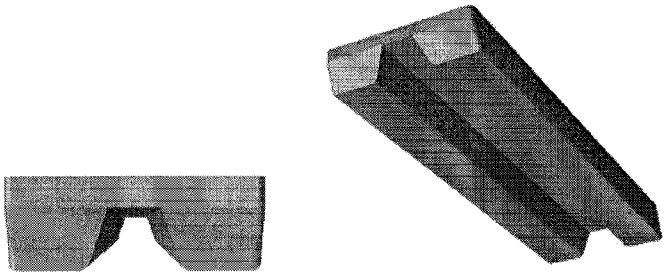
FIG. 3 illustrates an exemplary embodiment of a hull of catamaran configuration in accordance with an embodiment of this invention.
Figure 4:
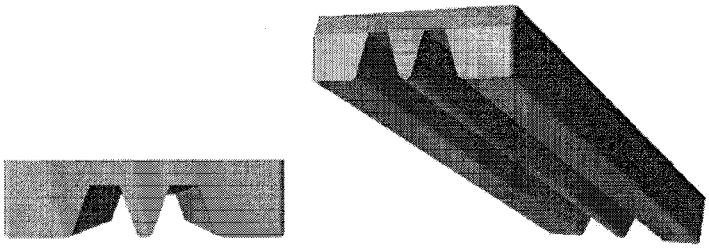
FIG. 4 illustrates an exemplary embodiment of a hull of trimaran configuration in accordance with another embodiment of this invention.

FIG. 1 shows a perspective view of the offshore drilling tender unit in accordance with an embodiment of the present invention. The drilling tender unit (10) comprises at least two elongated pontoon hulls (11, 12) disposed parallel to and spaced apart side-by-side in relation to one another. A deck box (13) having an upper surface (14) and a lower surface (15) is arranged and supported onto the at least two elongated pontoon hulls (11, 12) such that one of the elongated pontoon hulls (11) is disposed at a first longitudinal edge of the deck box (13) and another one of the elongated pontoon hulls (12) is disposed at a second longitudinal edge of the deck box (13), opposite the first longitudinal edge of the deck box.

The elongated pontoon hulls (11, 12) may be of any suitable size and shape depending upon the size of the deck box (13). The elongated pontoon hulls may have a uniform cross-section over its entire length or it may have a non-uniform cross section. In some particular embodiments, each of the elongated pontoon hulls (11, 12) has, over its entire length, a substantially trapezoidal cross-section, with a longest edge in contact with the lower surface (15) of the deck box (13). Each of the elongated pontoon hulls is of substantially equal length and the length is substantially the same as the length of the longitudinal edge of the deck box (13). A pontoon hull of this shape provides a higher added moment of inertia as compared to other shapes.

In accordance with some other embodiments of the present invention, the drilling tender unit (13) comprises a hull of trimaran configuration. In particular, the drilling tender unit (13) comprises a first, a second and a third elongated pontoon hulls (11, 12, 16). The first elongated pontoon hull (11) is disposed at the first longitudinal edge of the deck box (13) and the second elongated pontoon hull (12) is disposed at a second longitudinal edge of the deck box (13), opposite the first longitudinal edge of the deck box. The third elongated pontoon hull (16) is disposed between the first and the second elongated pontoon hulls and at the center of the lower surface of the deck box, and equal distant from the first and the second elongated pontoon hulls. The third elongated pontoon hull may be of the same shape and sizes as the first and the second elongated pontoon hulls or it may take on a different shape and sizes. In one embodiment, the third elongated pontoon hull (16) has, over its entire length, a substantially triangular cross-section, with its base in contact with the lower surface (15) of the deck box (13). FIG. 1 shows an example in accordance with a particular embodiment of this configuration.

It should be appreciated that the drilling tender unit shown in FIG. 1 is merely illustrated to provide one example of some embodiments of the present invention. Thus, one of ordinary skill in the art should readily appreciate that the present subject matter need not be limited to the arrangement of the equipment and the layout of the drilling tender unit as shown in FIG. 1.

The drilling tender unit in accordance with many embodiments of the present invention further comprises means for ballasting the elongated pontoon hulls when required, to adjust a draft between a relatively low draft condition and a relatively high draft condition. The means for ballasting are placed in each of the elongated pontoon hulls (not shown). The drilling tender unit may be raised or lowered by adjusting the ballasting of the elongated pontoon hulls. In operation, the pontoon hulls are submerged below water level, increasing the draft of the drilling tender unit. This facilitates the stability of the drilling tender unit.

Any suitable means for ballasting may be used in accordance with a number of embodiments of the present invention without departing from the scope of the invention. In accordance with many embodiments, the means for ballasting comprises a plurality of water ballast tanks. The plurality of water ballast tanks may be arranged and placed within the elongated pontoon hulls in any suitable manner. The mean for ballasting may further include means for adjusting trim and list of the drilling tender unit.

In accordance with some embodiments of the present invention, the drilling tender unit is a drilling tender barge. In accordance with some other embodiments, the drilling tender unit is a semi-submersible drilling tender.

In terms of arrangement, the hulls in trimaran or catamaran configuration can accommodate similar arrangement of equipment of either a typical semi-submersible drilling tender or a typical mono-hull tender barge. Some examples in accordance with various embodiments of the various arrangements in the prior art and in the present invention are shown in FIGS. 10 to 13.

Figure 10:
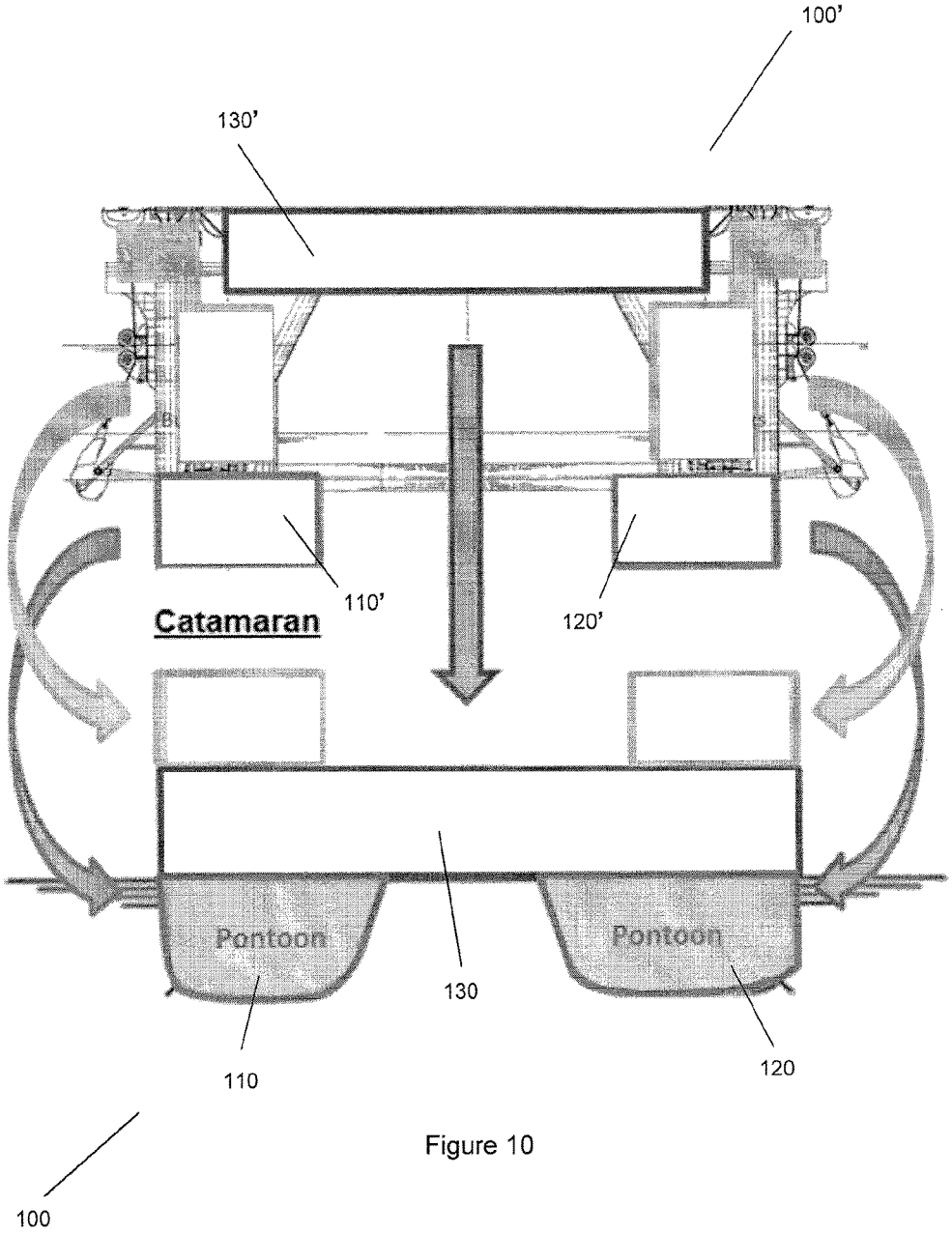
FIG. 10 illustrates the differences between a conventional semi-submersible drilling tender and the semi-submersible drilling tender comprising a hull of catamaran configuration in accordance with various embodiments of the present invention.
Figure 11:
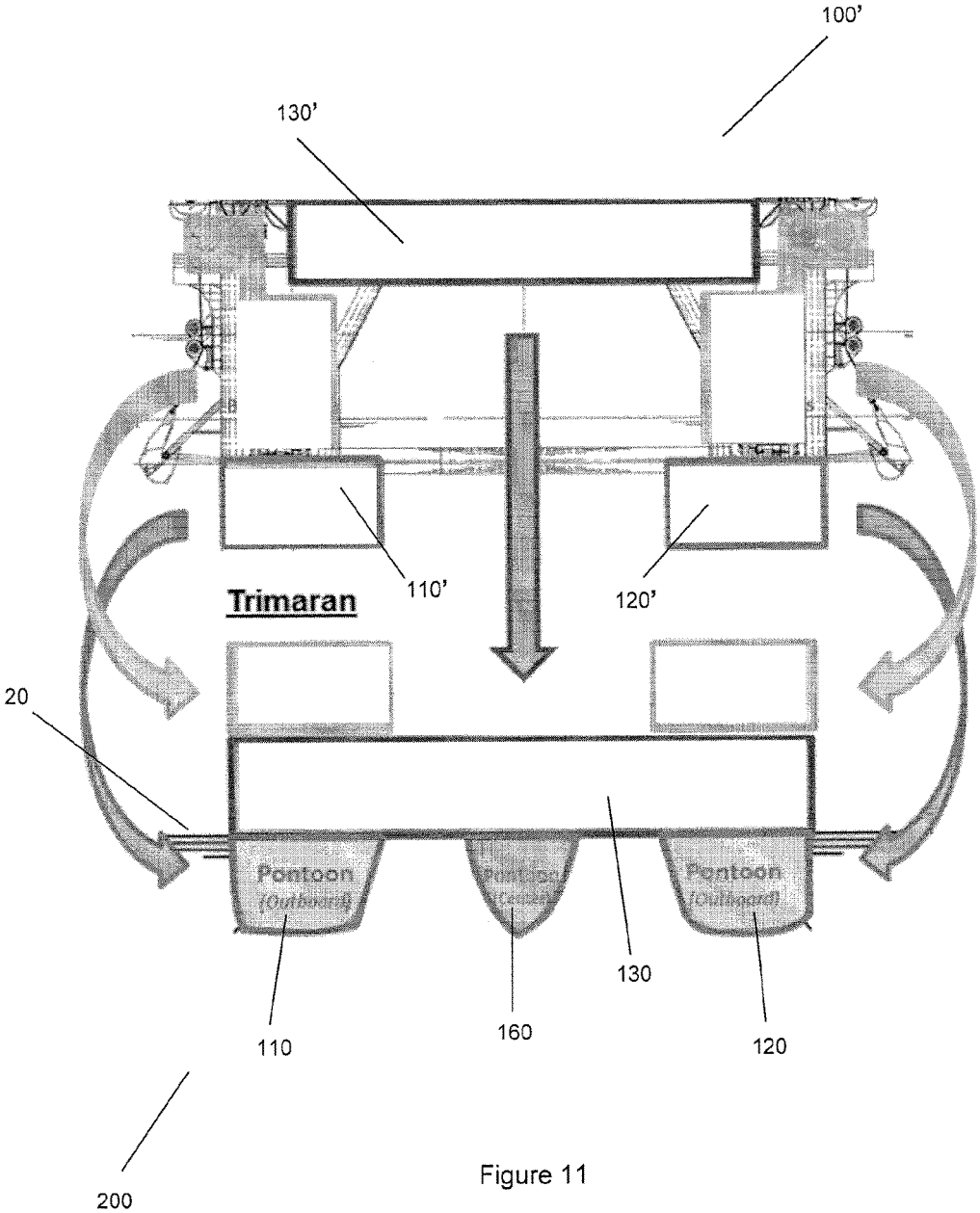
FIG. 11 illustrates the differences between a conventional semi-submersible drilling tender and the semi-submersible drilling tender comprising a hull of trimaran configuration in accordance with some other embodiments of the present invention.

FIG. 10 shows the difference in arrangement of different components between a conventional semi-submersible drilling tender (100') and the semi-submersible drilling tender having a hull of catamaran configuration (100) in accordance with an embodiment of the present invention. FIG. 11 shows the difference in arrangement of different components between a conventional semi-submersible drilling tender (100') and the semi-submersible drilling tender having a hull of trimaran configuration (200) in accordance with another embodiment of the present invention. In the embodiments shown in FIGS. 10 and 11, the equipment for use in drilling and/or other equipment for use on board the semi-submersible drilling tender can be placed inside the deck box (13) above the waterline (20). The means for ballasting (not shown) can be placed inside the elongated pontoon hulls (11, 12, 16) below the waterline (20). Equipment including, but not limited to, storage reels and bulk tanks from the semi-submersible drilling tender can be placed on top of the deck box (13) of the semi-submersible drilling tender (100, 200).

Figure 12:
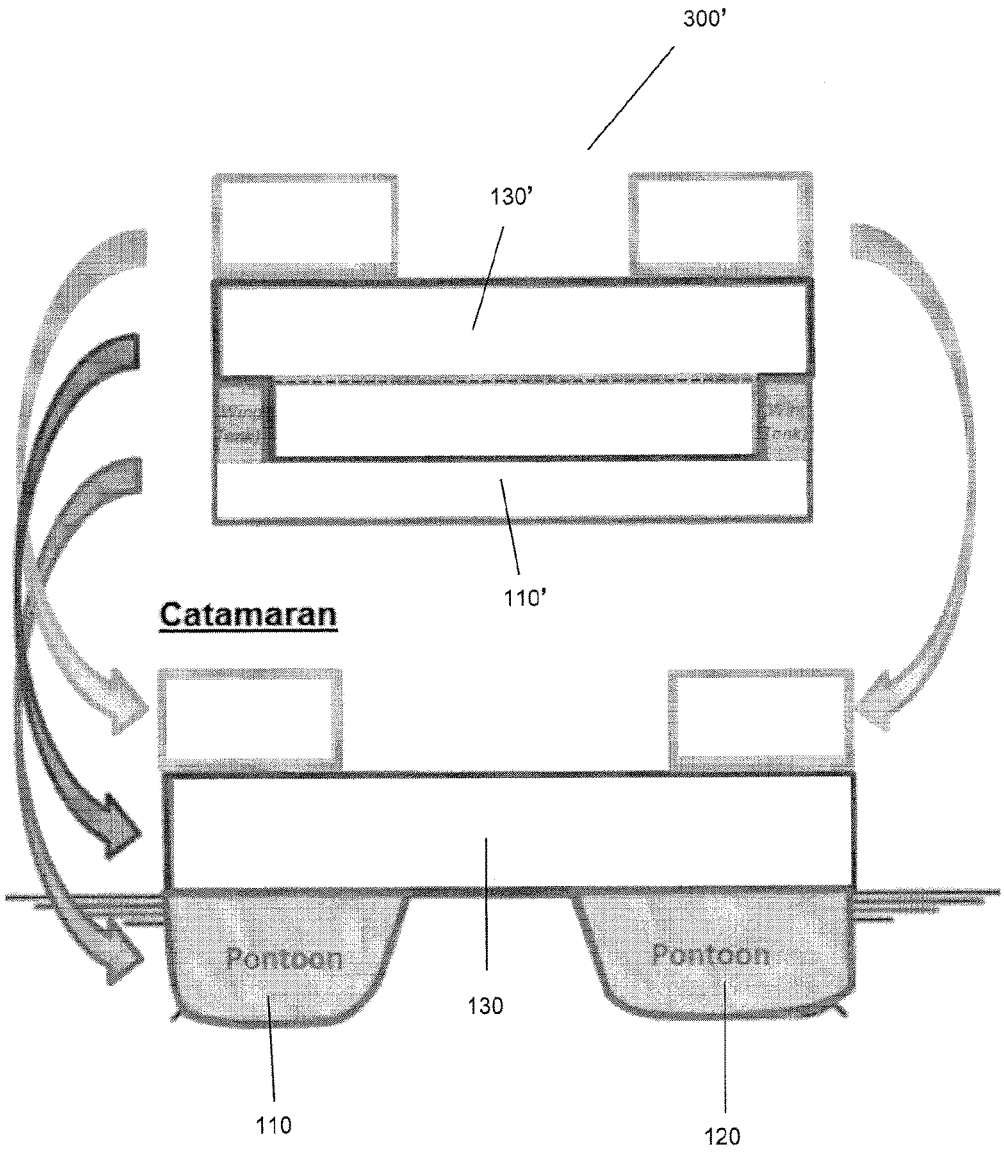
FIG. 12 illustrates the differences between a conventional mono-hull drilling tender barge and the drilling tender barge comprising a hull of catamaran configuration of some other embodiments of the present invention.
Figure 13:
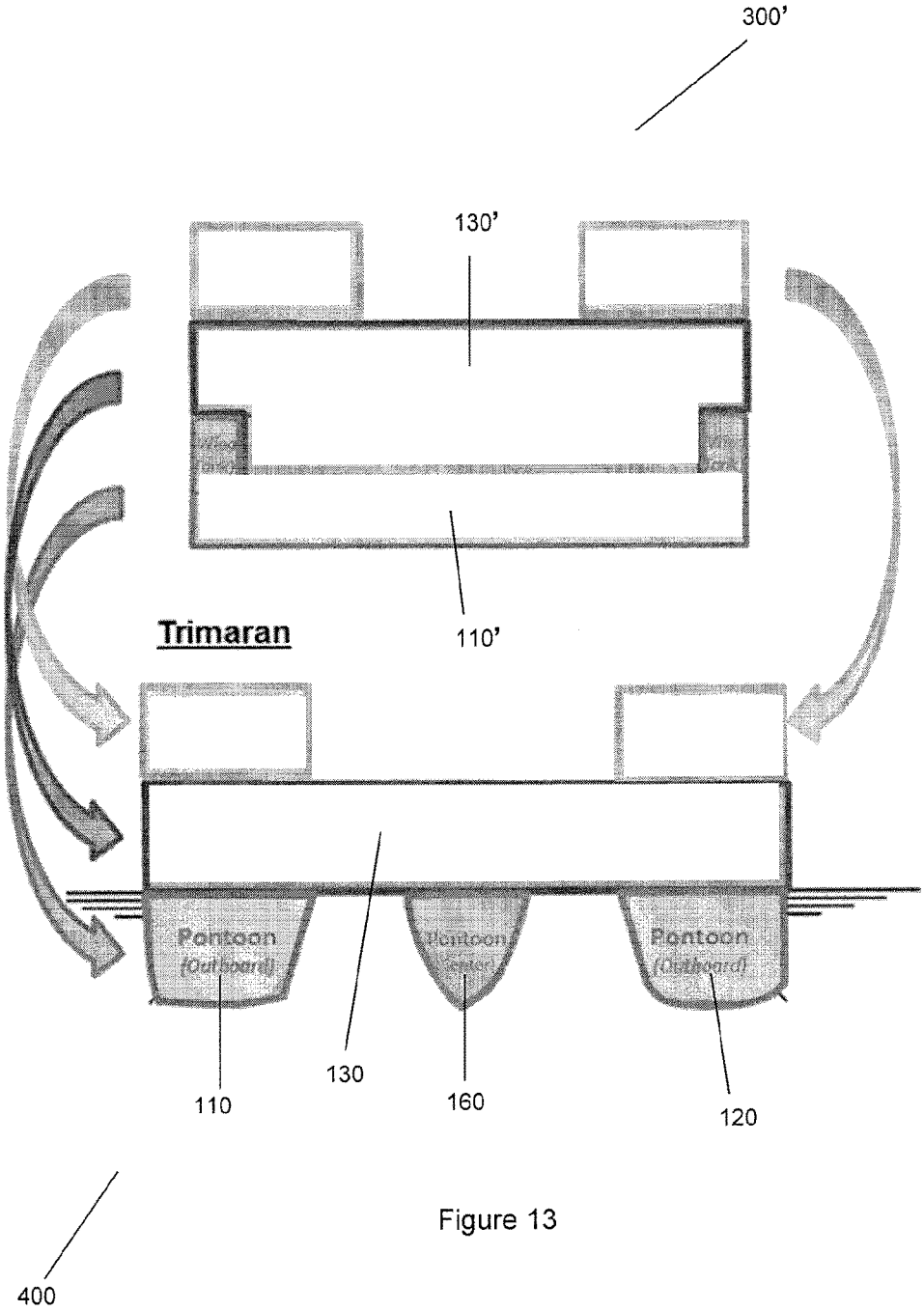
FIG. 13 illustrates the differences between a conventional mono-hull drilling tender barge and the drilling tender barge comprising a hull of trimaran configuration of in accordance with still other embodiments of the present invention.

FIG. 12 shows the difference in arrangement of different components between a conventional mono-hull tender barge (300') and the drilling tender barge having a hull of catamaran configuration (300) in accordance with an embodiment of the present invention. FIG. 13 shows the difference in arrangement of different components between a conventional mono-hull tender barge (300') and the drilling tender barge having a hull of trimaran configuration (400) in accordance with another embodiment of the present invention. In the embodiments shown in FIGS. 12 and 13, the equipment for use in drilling and/or other equipment for use on board the drilling tender barge can be placed inside the deck box (13) above the waterline (20). The means for ballasting (not shown) can be placed inside the elongated pontoon hulls (11, 12, 16) below the waterline (20). Equipment including, but not limited to, storage reels from the drilling tender barge can be placed on top of the deck box (13) of the drilling tender barge (300, 400).

The drilling tender units of the present invention has reduced vessel motion and improved operability. The two key design variables that bring out the benefits of seakeeping characteristics of a multi-hull drilling tender unit are:

(i) Wider beam that provides higher righting moment and hence reduce roll motion; and (ii) Lower water plane area which would reduce heave motion.

The drilling tender units of the present invention are designed to have low roll motion which will govern the crane operations in beam seas and quartering seas. A conventional mono-hull drilling tender barge will have a low roll natural period which will cause resonant motions more frequently. The new improved hulls of the present invention help to increase the natural period of roll and shift it away from the wave periods of typical operating environments.

The roll natural period is given by:

$$\text{Roll natural period} = 2\pi\sqrt{\frac{I_{xx} + I'_{xx}}{\rho g \nabla GM}}$$

$I_{xx}$ – Vessel Moment of Inertia $I'_{xx}$ – Added Moment of Inertia $\nabla$ – Displaced Volume The increase in natural period is contributed by a larger radius of gyration and an increased added moment of inertia. The added mass moment of inertia is much higher for the new improved hulls in accordance with many embodiments of the present invention as compared to a mono-hull which provides more resistance to roll motion. Increase in natural period of roll is also accompanied by a reduction in the resonance peak. This is due to the fact that the roll excitation moment decreases with increase in wave period. Since the roll response is proportional to the excitation moment, the response amplitude also decreases at higher periods.

The concept of adopting a hull of a trimaran or catamaran configuration on a drilling tender unit is an evolution of the tender barge design. With low water plane area and higher moment of inertia as the key advantages, the new improved concept is able to reduce wave frequency motion and shift peak period to longer duration for better crane operability in prevailing wind and severe deep sea conditions. These help to increase operating window and reduce idling time during operations.

EXAMPLES

Example 1—Assessment of Various Hull Forms

Figure 5:
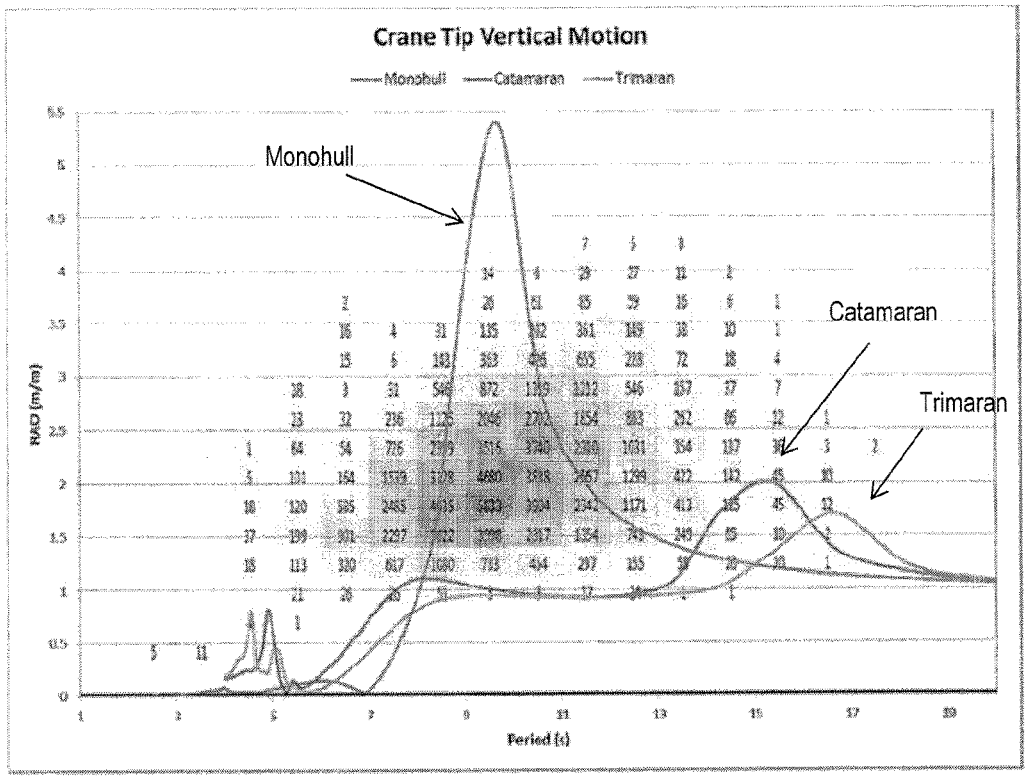
FIG. 5 is a chart showing typical Crane Tip Vertical Motion of barges with the various hull shapes.
Figure 6:
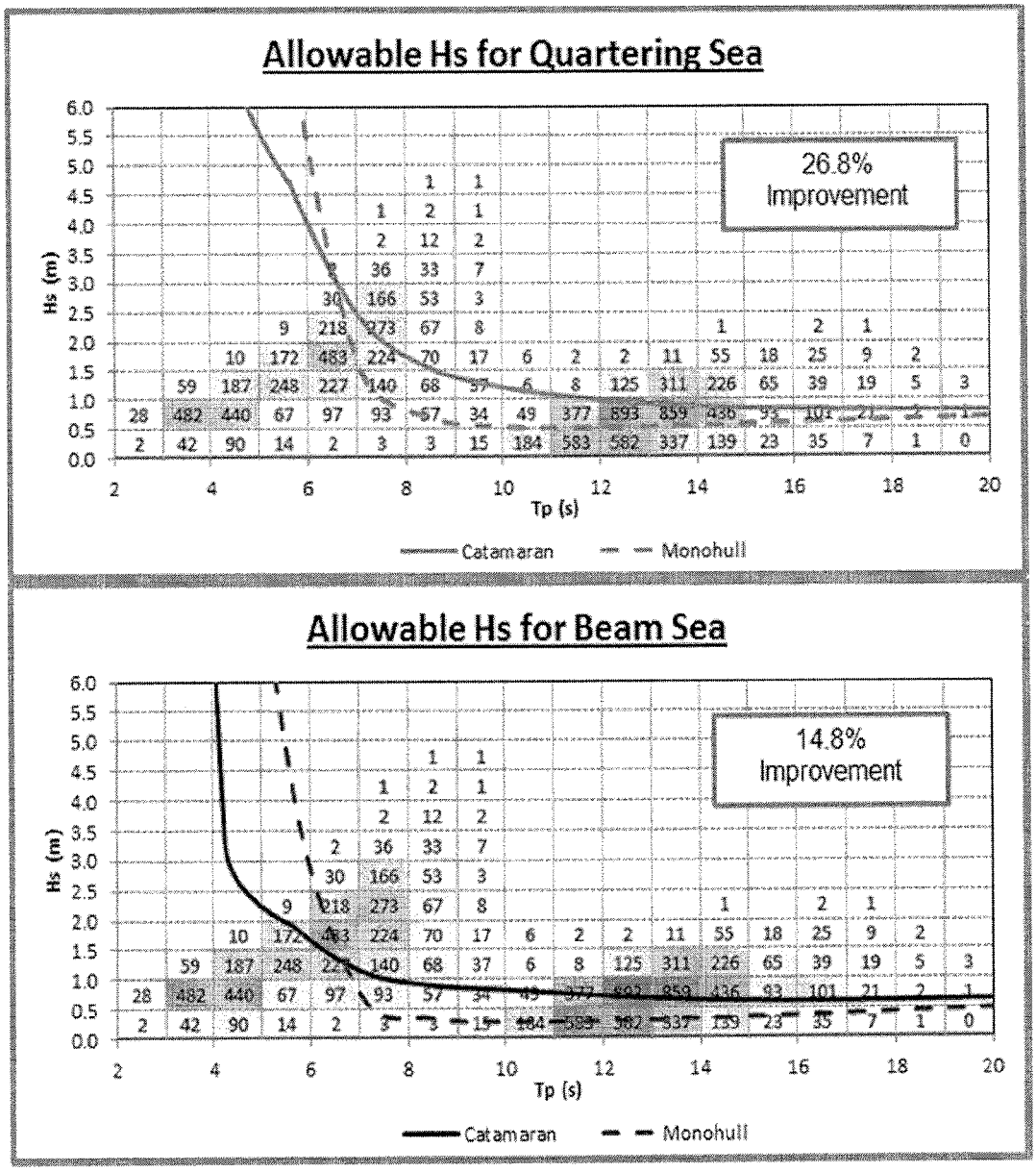
FIG. 6 is a chart showing the comparative operability performance between the drilling tender unit comprising a hull of catamaran configuration of the present invention and a conventional mono-hull barge under quartering sea and beam sea conditions.
Figure 7:
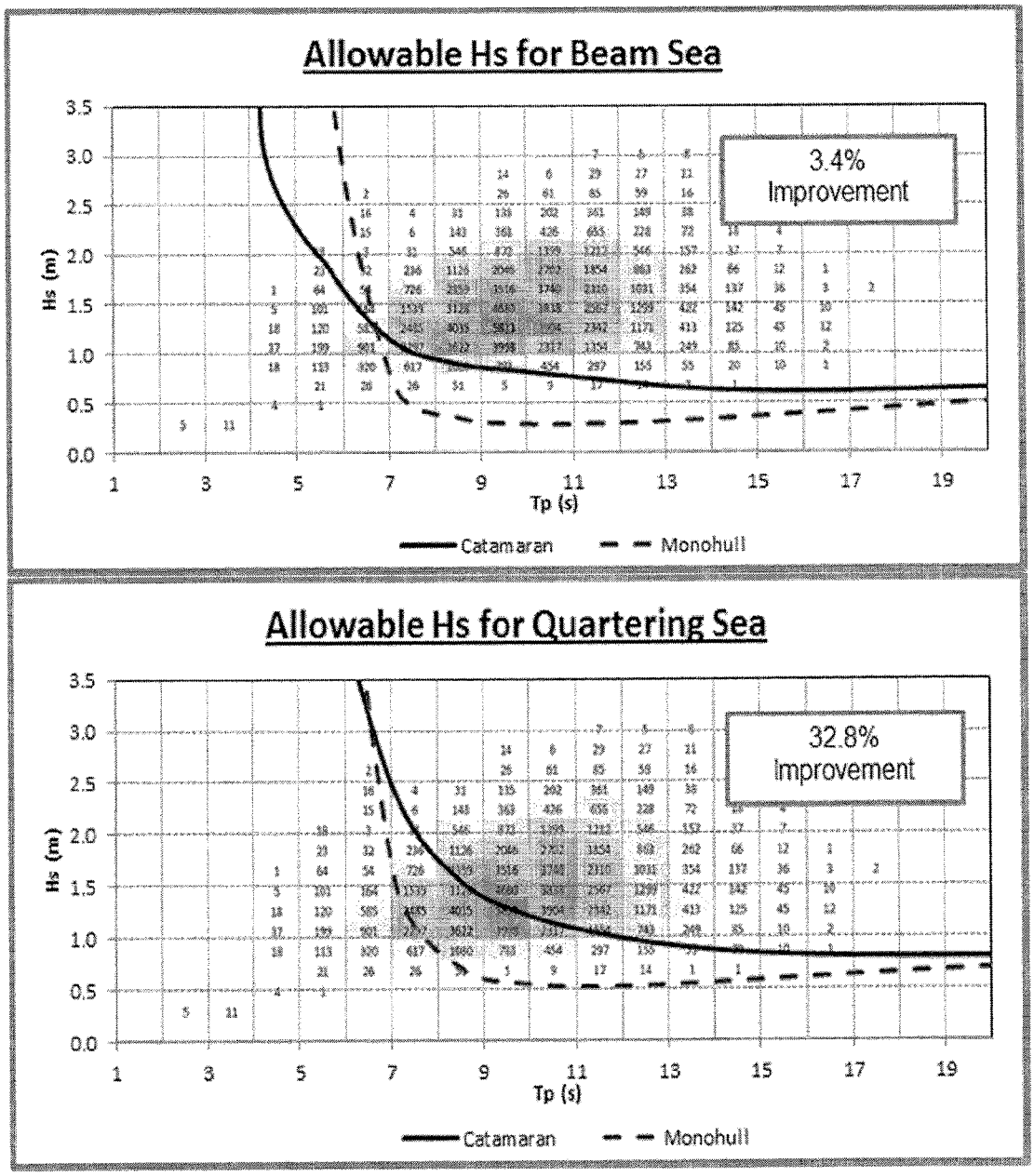
FIG. 7 is a chart showing the comparative operability performance between the drilling tender unit comprising a hull of catamaran configuration of the present invention and a conventional mono-hull barge under quartering sea and beam sea conditions of another region.
Figure 8:
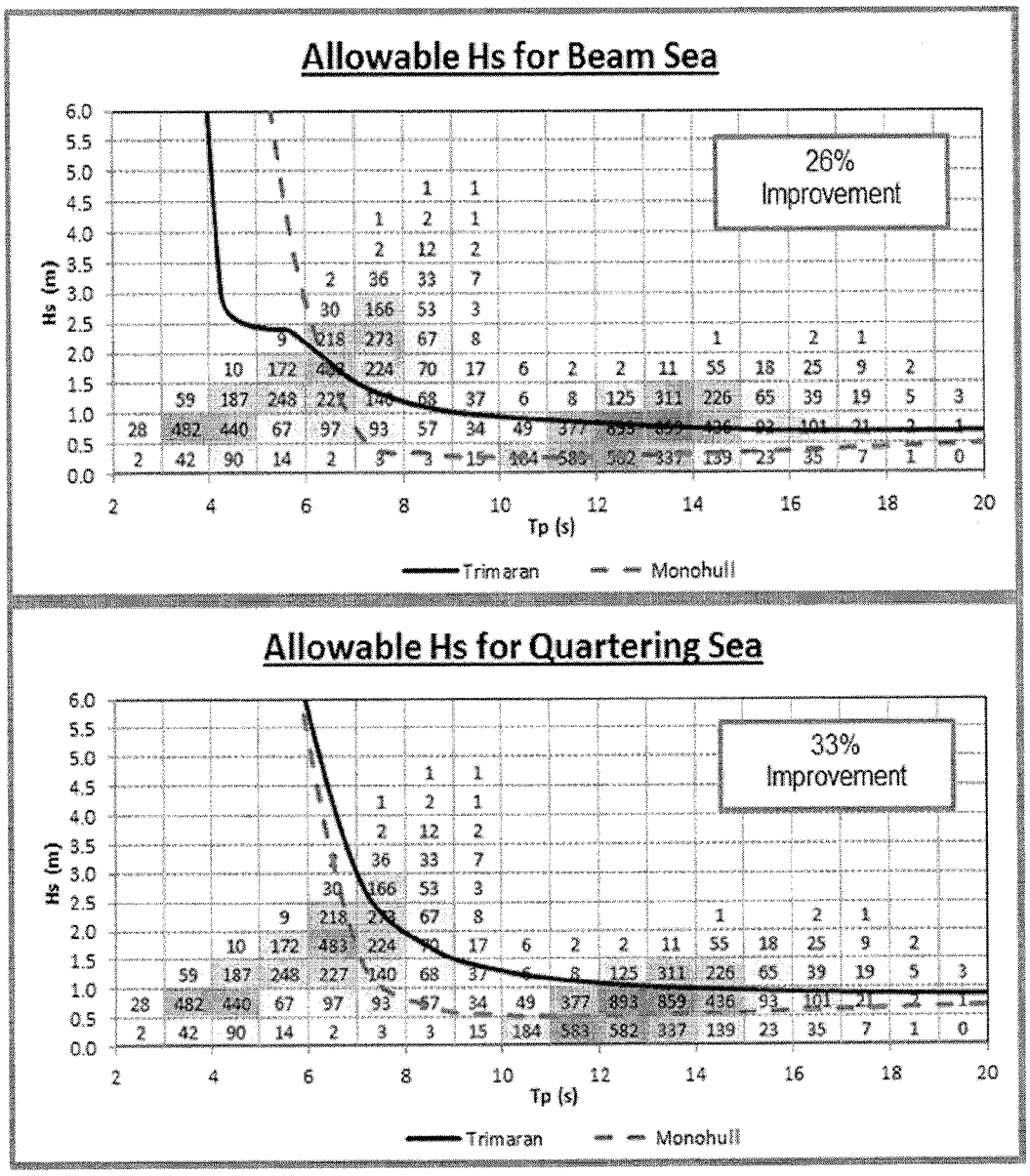
FIG. 8 is a chart showing the comparative operability performance between the drilling tender unit comprising a hull of trimaran configuration of another embodiment of the present invention and a conventional mono-hull barge under quartering sea and beam sea conditions.
Figure 9:
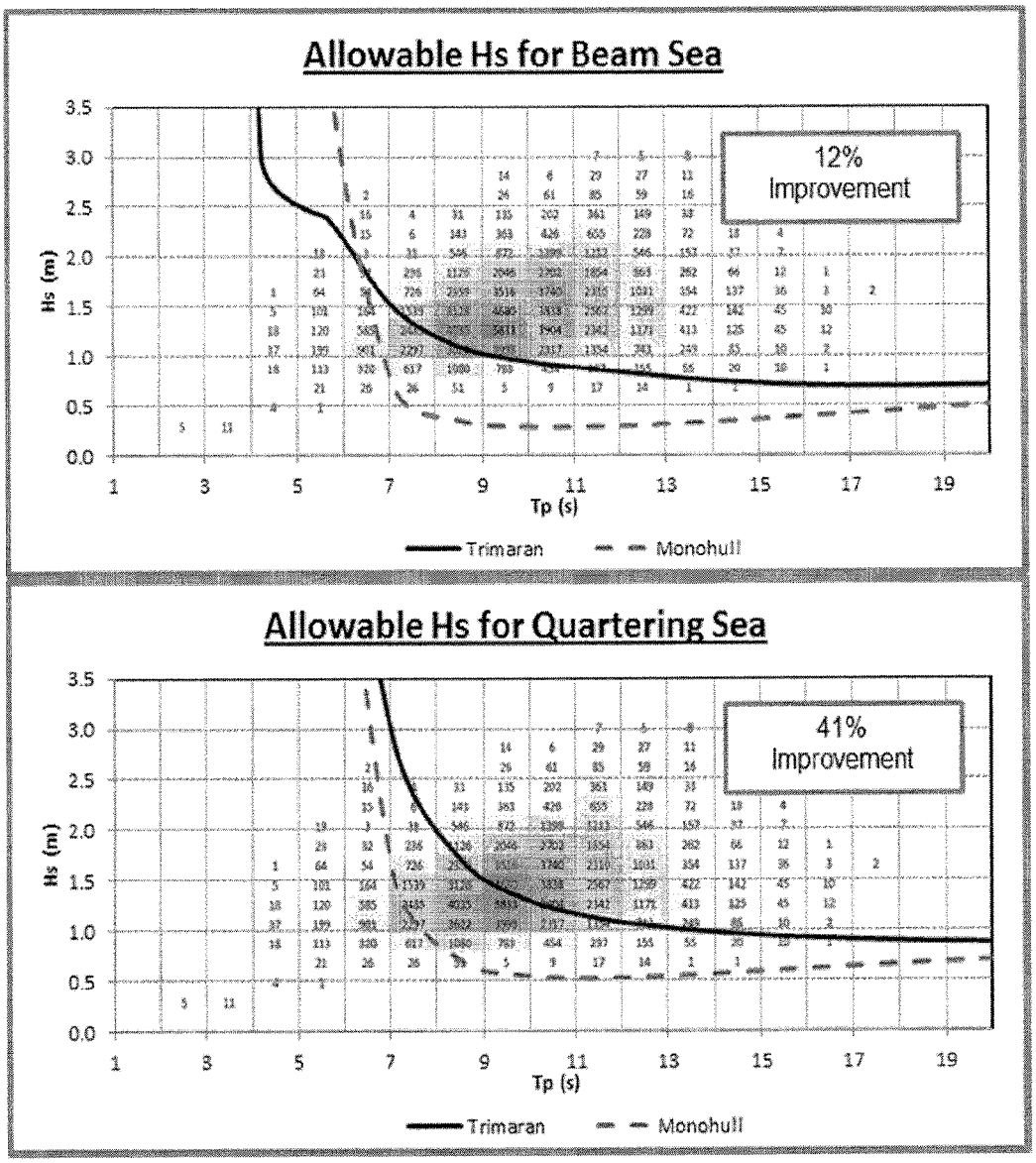
FIG. 9 is a chart showing the comparative operability performance between the drilling tender unit comprising a hull of trimaran configuration of another embodiment of the present invention and a conventional mono-hull barge under quartering sea and beam sea conditions of another region.

A study on motion and operability of mono-hull barge, trimaran and catamaran has been performed. The Crane Tip Vertical Motions of these hulls are overlaid on sea for comparison (see FIG. 5). The study shows that drilling tender units having a hull of trimaran and catamaran configuration are more beneficial in reducing the peak response and shifting the natural period of roll to higher period when compared to a conventional mono-hull tender barge. In terms of operability, both trimaran and catamaran show significant improvements (ranging from 3.4% to 41%) in the four experiments that were carried in different sea areas, under different see conditions (see FIGS. 6 to 9). The best improvement can be achieved when the drilling tender unit is encountering quartering sea conditions.

The above is a description of the subject matter the inventors regard as the invention and is believed that others can and will design alternative systems that include this invention based on the above disclosure.

The invention claimed is:

1. An offshore drilling tender unit comprising:

a first and a second elongated pontoon hulls disposed parallel to and spaced apart side-by-side in relation to one another;

a deck box having an upper surface and a lower surface, wherein the deck box is arranged and supported onto the two elongated pontoon hulls such that one of the elongated pontoon hulls is disposed at a first longitudinal edge of the deck box and another one of the elongated pontoon hulls is disposed at a second longitudinal edge of the deck box, opposite the first longitudinal edge of the deck box;

a third elongated pontoon hull disposed between the two elongated pontoon hulls and at the center of the lower surface of the deck box; and means for ballasting the drilling tender unit when required, to adjust a draft between a relatively low draft condition and a relatively high draft condition, wherein the means for ballasting are provided in each of the elongated pontoon hulls;

wherein the first and the second elongated pontoon hulls each having, over the entire length, a substantially trapezoidal cross-section, with a longest edge in contact with the lower surface of the deck box; and wherein the third elongated pontoon hull having, over the entire length, a substantially triangular cross-section, with its base in contact with the lower surface of the deck box.

2. The offshore drilling tender unit according to claim 1, wherein the means for ballasting include means for adjusting trim and list of the drilling tender unit.

3. The offshore drilling tender unit according to claim 1, wherein the drilling tender unit is a drilling tender barge.

4. The offshore drilling tender unit according to claim 1, wherein the drilling tender unit is a semi-submersible drilling tender.

* * * * *